United States Patent [19]

Debard

[11] 4,393,984

[45] Jul. 19, 1983

[54] VAPOR TAP VALVE FOR AEROSOLS

[75] Inventor: André Debard, Buc., France

[73] Assignee: Aerosol Inventions and Development AS AID SA, Fribourg, Switzerland

[21] Appl. No.: 186,661

[22] Filed: Sep. 12, 1980

[30] Foreign Application Priority Data

Sep. 20, 1979 [FR] France ..... 79 23394

[51] Int. Cl.[3] ..... B65D 83/14

[52] U.S. Cl. ..... 222/402.18; 222/402.22

[58] Field of Search ..... 222/402.18, 402.22, 222/402.24

[56] References Cited

U.S. PATENT DOCUMENTS

| | | | |
|---|---|---|---|
| 3,715,081 | 2/1973 | Green | 239/573 |
| 3,830,412 | 8/1974 | Green | 222/402.24 |
| 3,861,570 | 1/1975 | Green | 222/402.17 |
| 3,915,390 | 10/1975 | Green | 239/573 |
| 4,247,024 | 1/1981 | Vogel | 222/402.18 X |

FOREIGN PATENT DOCUMENTS

| | | | |
|---|---|---|---|
| 1366659 | 11/1962 | France . | |
| 2101366 | 3/1972 | France . | |
| 2130054 | 11/1972 | France . | |
| 2295328 | 7/1976 | France . | |
| 2416853 | 2/1978 | France . | |
| 832507 | 4/1960 | United Kingdom | 222/402.24 |
| 879055 | 10/1961 | United Kingdom | 222/402.22 |
| 2019498 | 10/1979 | United Kingdom | 222/402.18 |

*Primary Examiner*—David A. Scherbel

*Attorney, Agent, or Firm*—Finnegan, Henderson, Farabow, Garrett & Dunner

[57] ABSTRACT

Vapor tap valve for use in particular with fluids having a propellant gas which is inmiscible. A number of passages for the liquid/gas mixture between the interior of the valve shell where single entry points are provided, separate for the liquid and for the gas; these passages abutting on the passage of the actuating stem of the valve. A better mixing of the gas with the liquids is obtained with a path for a gas access to the interior of the outlet valve as short as possible up to the outlet passage of the valve. The incoming extra gas enters immediately next to the inner surface of the sealing gasket.

5 Claims, 7 Drawing Figures

VAPOR TAP VALVE FOR AEROSOLS

The present invention relates to the field of aerosols. It is concerned in particular with a vapour tap valve for use in particular with fluids having a propellent gas which is inmiscible.

In such packages it is necessary to mix the product which is to be dispensed, in the form of a powder or a foam, with the gas which is present separately in the gaseous phase above the liquid mixture of the product to be dispensed and of liquified propellant, trapped within the container fitted with the valve.

Experience shows that a better mixing of the gas with the liquids is obtained within a valve comprising an outlet valve member and two separate inlets, one for the gas and the other for the liquid, if the path for access to the interior of the outlet valve is as short as possible up to the outlet passage of the valve.

Thus in valves of the well known type it has been possible to ascertain that a finer and finer break-up is obtained when the inlet orifice for the gas into the valve is brought very close to the sealing gasket of the valve member that controls dispensing.

Thus a situation is reached in which the incoming extra gas enters immediately next to the inner surface of the sealing gasket.

However the path for entry of the mixture of liquid and gas into the dispensing passage is, generally speaking, in the form of a single orifice or notch localised radially with respect to the outlet passage.

For reasons of ease of manufacture and of reliable operation, the dispensing passage is able to turn freely around its axis. Consequently the orifice by which the mixture of liquid product and gas enters might be disposed in a position facing the entry point of the additional gas (vapour tap) or equally well opposite it.

The results are different according to the orientation, the better results being obtained when the communicating orifice and the vapour tap orifice face one another.

It will be clear that, if a number of paths are present for entry of the extra gas, the gas automatically follows the path which offers the least pressure drop, that is to say the most direct path.

With the aim of improving valves of this type it has already been proposed to distribute several gas entry paths all around the valve member that is fitted with the outlet passage.

This solution to the problem does give adequate results but has the major drawback that it does not allow effective control of the amount of gas admitted to the valve.

The aim of the invention is to overcome the drawbacks of the known valves. It allows the provision of a valve having a number of passages for the liquid/gas mixture between the interior of the valve shell where single entry points are provided, separate for the liquid and for the gas; these passages abutting on the passage of the actuating stem of the valve, with at the same time the possibility of regulating in an effective manner the flow of liquid and/or of extra gas and/or of liquid/gas mixture.

The subject of the invention is a vapour tap valve for aerosol packages comprising a cup for crimping onto a container. This cup carries a valve shell held against an annular sealing gasket centred on an axial opening in the cup. The shell encloses and guides axially a spring-loaded valve member and its spring urges the member into sealing engagement with the gasket. This shell has, in the immediate neighbourhood of the gasket, at least one passage for the said gas, and opens at the opposite side of the gasket into a tube providing access for the liquid carried by the shell. The spring-loaded valve member or cup is extended axially by a hollow actuating stem for the said valve and for dispensing a mixture of the said liquid and gas, the said tube passing in a sealing manner through the said gasket. The valve which forms the subject of the invention is characterised by the fact that the spring-loaded cup has a plurality of closable passages past the said gasket and providing communication from the interior of the said shell to the hollow actuating stem.

According to one particularly advantageous embodiment the spring-loaded cup has, facing the gasket, a cylindrical axial recess of polygonal shape in which is held the actuating stem in the shape of a cylinder of revolution, which opens freely into the bottom of the recess.

The actuating stem could be trapped between the faces of the polygonal wall and a central cylindrical peg, the internal wall of the said stem being traversed by at least one groove for the free passage of the mixture of liquid and gas over a least the height of the said peg.

The actuating stem could be held in the spring-loaded cup with the aid of a retaining rib on at least one of the faces of the polygonal wall. According to one embodiment of the invention the bottom of the recess in the spring-loaded cup has an abutment that limits the entry of the stem, the said abutment being intersected by at least one groove providing communication between the axial opening in the said tube and all the passages formed between the polygonal wall of the said recess and the outside wall of the said stem.

A valve according to the invention could have at least one calibrated passage in at least one of the respective paths of the liquid, or the gas and/or of the liquid/-gas mixture.

By the term liquid it will be understood that we mean both a liquid in the conventional sense of the word and also any other fluid substance, in particular a powder, capable of flowing like a liquid.

The invention will be better understood by a study of the following detailed description in conjunction with the accompanying drawings which illustrate, by way of non-limiting example, one embodiment and a modification.

Figure 2:
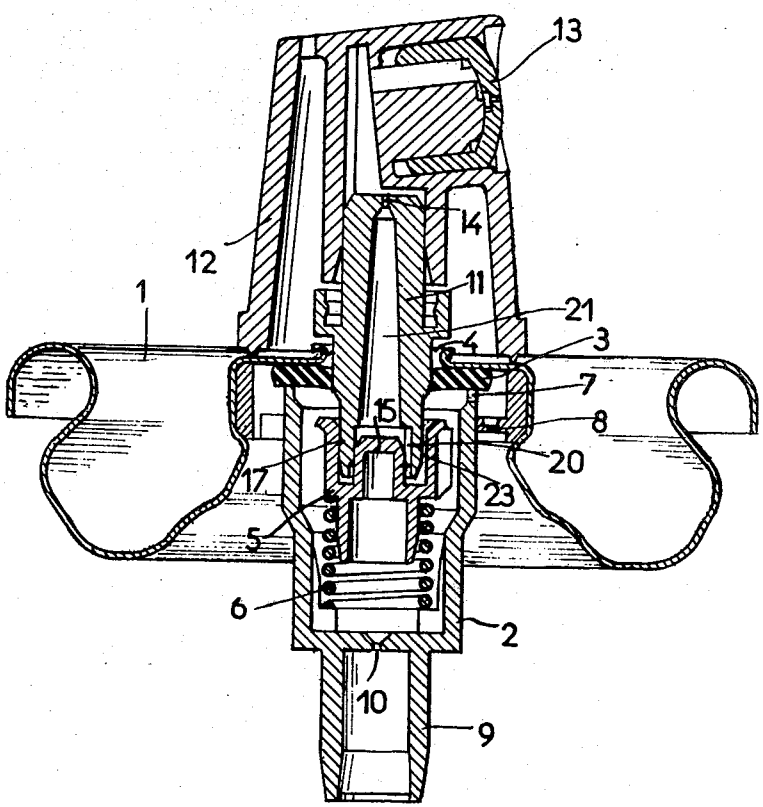
FIG. 2 is a view similar to FIG. 1 but showing the same valve in the open position.
Figure 1:
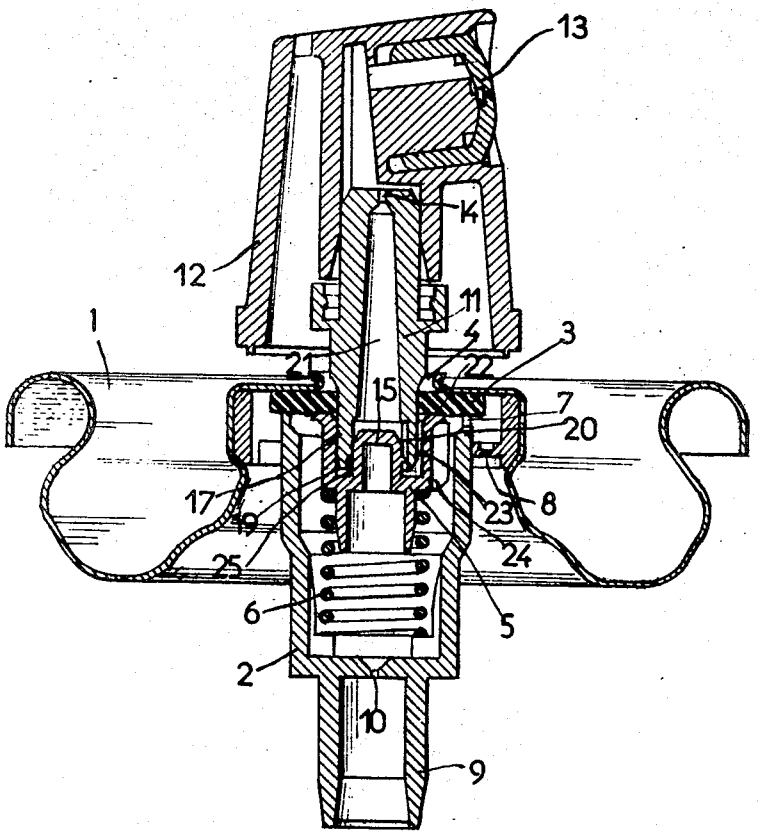
FIG. 1 is a sectioned diagrammatic diametrical view of a valve according to the invention, shown in its closed position.
Figure 3:
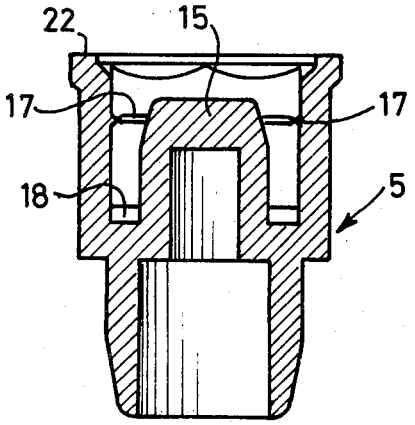
FIG. 3 is a diagrammatic diametrical section through the spring-loaded valve cup of the valve of FIGS. 1 and 2.

The valve illustrated in FIGS. 1 and 2 comprises a known form of mounting cup 1 for crimping onto a container. This mounting cup carries a valve shell 2 which is urged into engagement with an angular sealing gasket 3 centred on an axial opening 4 in the mounting cup 1.

The valve shell 2 encloses and guides axially a valve member or cup 5 urged by a spring 6 into sealing engagement with the gasket 3.

In the immediate neighbourhood of the gasket 3, the shell 2 has an opening 7 for the admission of gas. The flow is controlled by a calibrated orifice 8.

At the opposite end from the gasket 3, the valve shell leads into a tube 9 for admitting liquid, flow of which is regulated by a calibrated orifice 10. Inserted forcibly into the valve member or cup 5 is one end of a hollow actuating stem 11 which forms a path for the mixture of liquid and gas to be dispensed into a pushbutton 12 of known kind, fitted with a swirl-type spray break-up insert 13 of known kind.

Figure 5:
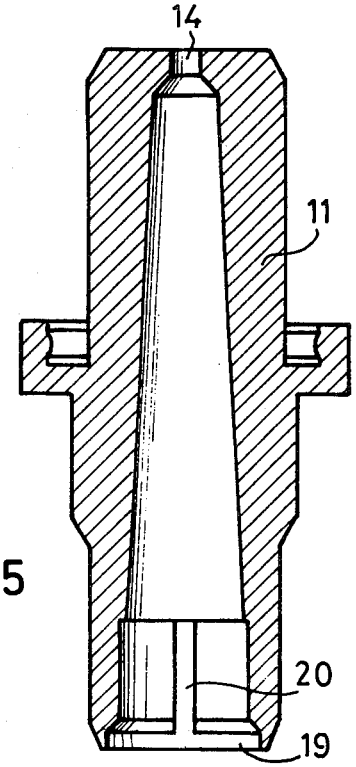
FIG. 5 is a diagrammatic diametrical section through the hollow actuating stem of the valve of FIGS. 1 and 2.
Figure 4:
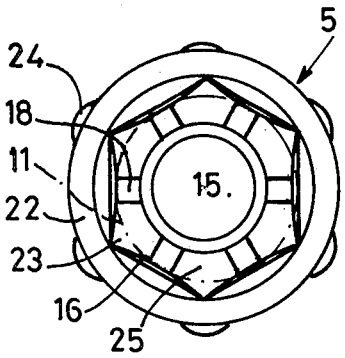
FIG. 4 is a view of the valve cup of FIG. 3 from above.
Figure 7:
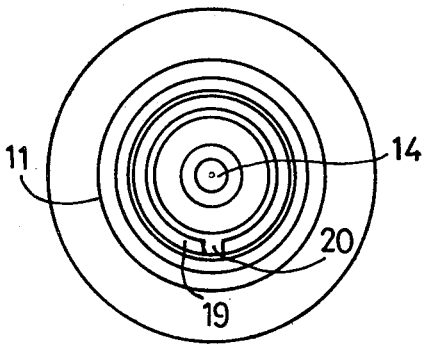
FIG. 7 is a view from below of the actuating stem of FIG. 5.

At its upper end the actuating stem 11 has an outlet orifice 15 of calibrated size (FIGS. 1, 2 and 5).

Figure 6:
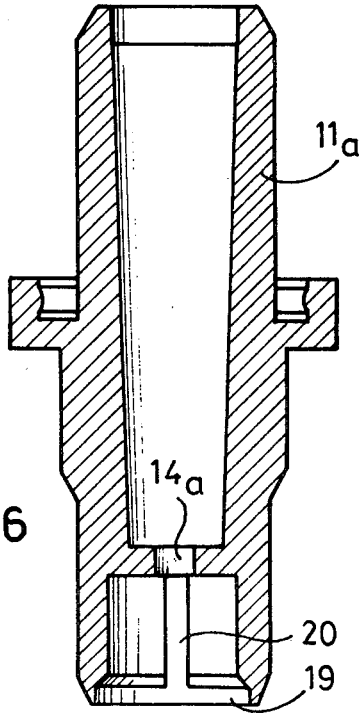
FIG. 6 is a view similar to FIG. 5, showing a modification.

In the modification shown in FIG. 6, this calibrated orifice 14*a* is present in the lower part of the stem 11 (or rather 11*a* in FIG. 6).

The lower end of the hollow actuating stem 11 is trapped between a cylindrical axially extending peg 15 in the valve member 5 and the polygonal (hexagonal) wall 16 of the cavity around the peg 15.

Little elongated ribs 17 projecting from each polygonal wall 16 ensure that the stem 11 is held firmly in the valve member 5.

The base of the polygonal recess in the valve member 5 has ribs and is intersected by grooves defined by radial ribs 18 which join the base of peg 15 to the centre of each of the polygonal walls 16.

That end of the stem 11 which is inserted over the peg 15 is internally intersected by a groove 20 which leads into an annular gallery 19 formed in this end of the stem 11.

Thus, in its rest position (FIG. 1), the valve is perfectly fluid-tight as all communication between the interior of the container on which it is mounted and the outlet passage 21 of the actuating stem 11 is blocked by the upper rim 22 of the valve member or cup, which is urged resiliently against the sealing gasket 3 by the spring 6.

When the valve is open the liquid coming up through the tube 9 enters the interior of the valve member or cup 2 through the calibrated orifice 10, whilst the gas enters the same valve member or cup throught the calibrated orifice 8 and the passage 7.

The liquid/gas mixture can then penetrate between the free clearances 23 formed between the polygonal walls and the cylindrical lower end of the stem 11; from there it reaches the passage 21 within the stem 11 through the clearances 25 between each rib 18, the recess 19 and the wall 20. The gas automatically follows the shortest path between the groove 20 and the passage 7 in view of the fact that a number of paths 23 (6 in all) present themselves.

The mixture of liquid and gas is then dispensed through the nozzle 13 under the control of the calibrated orifice 14 (or 14*a* in the modification shown in FIG. 6).

All axial movement of the valve member or cup 5 is guided within the shell 2 in a known manner by longitudinally extending ribs 24 projecting from the outer surface of the member 5.

It will be understood that the invention is not limited to the embodiment described and illustrated but is open to numerous modifications available to a person skilled in the art, without departing from the scope of the invention.

I claim:

1. A vapour tap valve for aerosol packages comprising a mounting cup for crimping onto a container containing liquid and gas, said mounting cup carrying a valve shell held clamped against an annular sealing gasket centred on an axial opening in said mounting cup, said valve shell enclosing and guiding axially a spring-loaded valve member with a spring urging said valve member into sealing engagement with said gasket, said shell having in the immediate neighbourhood of said gasket at least one passage for admitting additional gas from said container into said shell and having, at the opposite end from said gasket, a liquid inlet tube, said valve member being axially extended by a hollow actuating and dispensing stem for said valve for dispensing a mixture of said liquid and gas, and said stem passing in a sealing manner through said gasket; said valve being characterised in that said actuating stem and said valve member define between them a plurality of passages closable by said gasket and effective, when opened, to conduct a flow of mixed liquid and additional gas from the interior of said shell to the interior of said actuating stem, wherein said valve member has, facing the gasket, a cylindrical axial recess of polygonal section in which is secured the hollow actuating stem in the form of a cylinder of revolution which opens freely to the base of said recess, forming at least five circumferentially spaced passages capable of being closed off by said gasket and of providing communication between the interior of said shell and said hollow actuating stem.

2. A valve according to claim 1 characterised in that the hollow actuating stem is trapped between the faces of the polygonal recess and a central cylindrical peg, the internal wall of the said stem being traversed by at least one groove for the free passage of the mixture of liquid and gas over at least the height of the said peg.

3. A valve according to claim 1 characterised in that at least one of the faces of the polygonal recess has a projection for retaining the stem.

4. A valve according to claim 1 characterised in that the base of the recess of the valve member has an abutment limiting entry of the stem, said abutment being intersected by at least one groove providing communication between the axial opening in said stem and all of the passages formed between the polygonal recess and the outside wall of said stem.

5. A valve according to claim 1 characterised in that it has at least one calibrated passage on at least one of the respective paths of the liquid, the gas and the liquid/gas mixture.

* * * * *